United States Patent [19]

Schildkraut et al.

[11] Patent Number: 4,484,790

[45] Date of Patent: Nov. 27, 1984

[54] ANTI-DECOUPLING DEVICE FOR AN ELECTRICAL CONNECTOR

[75] Inventors: Alan L. Schildkraut, Sidney; Dee A. Werth, Bainbridge, both of N.Y.

[73] Assignee: The Bendix Corporation, Southfield, Mich.

[21] Appl. No.: 480,190

[22] Filed: Mar. 30, 1983

[51] Int. Cl.[3] ..... H01R 13/623

[52] U.S. Cl. ..... 339/89 M; 339/DIG. 2

[58] Field of Search ..... 339/89 R, 89 C, 89 M, 339/90 R, 90 C, DIG. 2; 285/82, 87, 88, 92

[56] References Cited

U.S. PATENT DOCUMENTS

| | | | |
|---|---|---|---|
| 4,066,315 | 1/1978 | Arneson | 339/89 M |
| 4,074,927 | 2/1978 | Ball | 339/89 M |
| 4,109,990 | 8/1978 | Waldron et al. | 339/89 M |
| 4,165,910 | 8/1979 | Anderson | 339/89 M |
| 4,183,605 | 1/1980 | Arneson | 339/89 M |
| 4,268,103 | 5/1981 | Schildkraut et al. | 339/89 M |

*Primary Examiner*—John McQuade

*Attorney, Agent, or Firm*—C. D. Lacina

[57] ABSTRACT

A compound coupling nut (60) mounted to a plug shell (10), first and second sets of detents (34, 84) arranged annularly and extending radially inward from one of the shell and/or the inner coupling sleeve, and a C-shaped detent spring (90) disposed radially-between the first and second detents, the detent spring having inwardly directed spring fingers (100) adapted to engage the ratchet teeth (34) and detent lugs (98) adapted to engage the arcuate detents (84), the detent spring (90) respectively, resisting and not resisting rotation of the coupling nut if rotated in one or the other directions, whereby as external coupling torques act on the coupling nut (60), the spring fingers (100) do not prevent rotation and as external uncoupling torques act on the coupling nut (60), the spring fingers (100) and the detent lugs (98) initially cooperate to resist rotation of the detent spring (90) and the coupling nut (60) until sufficient torque causes the detent lugs (98) to snap free, whereby uncoupling rotation of the coupling nut takes place.

13 Claims, 7 Drawing Figures

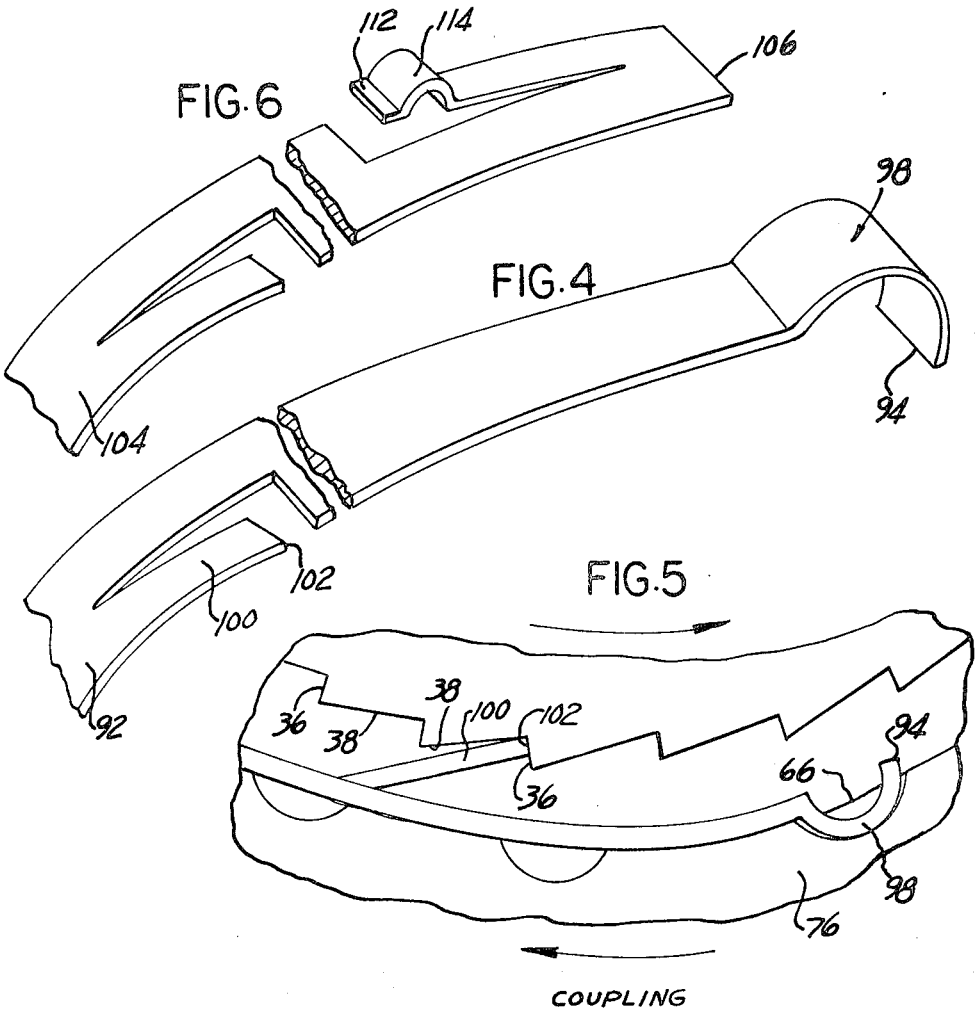
FIG. 6
112
114
106
FIG. 4
98
94
104
102
100
92
FIG. 5
36
38
38
100
102
36
66
94
98
76
COUPLING
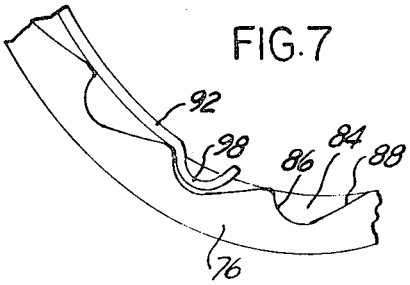
FIG. 7
92
98
86
84
88
76

ANTI-DECOUPLING DEVICE FOR AN ELECTRICAL CONNECTOR

This invention relates to an anti-decoupling device for an electrical connector.

Electrical connector assemblies are generally comprised of two separate connector members and a coupling member mounted to one of the connector members, each of the respective connector members supporting a plurality of electrical contacts for mating when the connector members are connected together by the coupling member engaging the other connector member. During mating and unmating the connector members must be easily coupled and decoupled with use of reasonable force. Once mated and in use, however, the connector assembly must remain connected despite vibrational and/or other forces which might be applied to the connector assembly and which might tend to uncouple the assembly.

Various anti-decoupling devices for resisting unwanted rotation are known. In U.S. Pat. No. 4,109,990 issuing Aug. 29, 1978 to Waldron et al and in U.S. Pat. No. 4,268,103 issuing May 19, 1981 to Schildkraut et al, each titled "Electrical Connector Assembly Having Anti-Decoupling Mechanism," a straight spring beam is radially interposed between the coupling member and one of the connector members, the one connector member having a plurality of ratchet teeth arranged annularly and extending radially outward therefrom and the spring beam having a medial tooth arranged such that when the coupling member is rotated in either direction the medial tooth engages successive of the ratchet teeth to resist rotation. In these patents the anti-rotation spring beam is self-contained and protected during use but the term ratchet teeth is misused in that the spring beam allows two way rotation of the coupling nut.

However, while such a spring beam is suitable for use in many applications, in some vibration environments, the straight beam could bow upwardly and the medial tooth removed from positive engagement with the ratchet teeth resulting in the coupling nut backing-off from tightly coupled relation, such backing-off allowing the connector members to axially hammer against one another.

Oftentimes electrical circuitry must be protected from disruptions caused by electromagnetic interference (EMI) entering the system. Connectors are particularly susceptible to EMI energy because of numerous contact areas and openings for cable and external electrical contacts. One approach in preventing disruption from EMI is to ensure that metal-to-metal contact exist between end faces on each connector member. This requires that axial back-off be prevented.

Ratchets and pawls are known to allow movement in one direction but prevent reverse movement in the other direction. However, since an electrical connector must be capable of being both coupled and uncoupled, a suitable anti-decoupling device must allow the coupling nut to rotate in opposite directions.

A desirable anti-rotation device for a separable electrical connector would be protectively enclosed and self-contained, combine the sureness of a ratchet without sacrifice of wanted uncoupling capability, would readily permit connection and/or disconnection and would provide increased resistance to uncoupling torques to resist unwanted uncoupling of the assembly formed.

Accordingly, the present invention is directed to an electrical connector having improved anti-decoupling which overcomes the difficulties and disadvantages associated with prior electrical connectors. An electrical connector assembly of the present invention generally comprises complementary plug and receptacle connector members, a coupling nut rotatably mounted to the plug connector and adapted to connect to the receptacle connector for axially drawing the connectors together upon rotation of the coupling nut in one direction and an anti-decoupling device for resisting unwanted uncoupling rotation of the coupling nut, each connector member comprising a generally cylindrical shell with the receptacle shell having thread formed on a forward portion thereof and the coupling nut having thread formed on an interior portion thereof engagable with the exterior thread of the one connector member to hold the connector members together when in their fully mated assembly.

The anti-decoupling device is adapted to resist rotation of the coupling nut in one direction only relative to the connector member to which the nut is mounted and characterized by first and second sets of radially extending and annularly arranged detents and a detent spring radially interposed between the two sets of detents, one set of detents being disposed around the plug shell and including a plurality of abutment faces and the other set of detents being disposed around the inside surface of the coupling nut and including a plurality of first and second detent faces. The detent spring comprises a generally flat arcuate band including at least one spring finger and at least one detent lug, the spring finger and detent lug extending radially from opposite surfaces of the arcuate band with the spring finger extending as a cantilever and having a free end adapted to seat within the one set of detents and against respective of the abutment faces and the detent lug being formed on the band and adapted to be seated within and between the first and second detent faces of the other set of detents, the spring finger and detent lug cooperating with their respective detents to allow unimpeded rotation of the coupling nut in the coupling direction but to resist rotation of the coupling nut in the uncoupling direction, whereby application of external coupling torque to the coupling nut constrains the detent spring to rotate with the coupling nut and the spring finger to deflect and advance from one abutment face to another abutment face but upon application of external uncoupling torque to the coupling nut the detent lug transmits force through the detent spring to the spring finger and the abutment face prevents rotation of the detent spring and thus the coupling nut, increased external uncoupling torques causing the detent lug to be cammed radially from engagement with its detent, whereby the coupling nut breaks free to rotate in the uncoupling direction.

To increase resistance to uncoupling, the detent spring, includes two spring fingers and two detent lugs, the spring being generally C-shaped with opposite ends thereof subtending an angle greater than 180°, one detent lug being disposed at each opposite end of the C-spring and the spring fingers being disposed between the ends.

In one embodiment, the one connector member includes an annular flange, the first set of detents are generally V-shaped and disposed annularly around the annular flange, the second set of detents are generally circular and disposed annularly around the coupling nut, the spring band is flat and rectangular in cross-section with the long dimension thereof being aligned with the axis, the spring finger extends radially inward from the inner surface of the spring band to engage the V-shaped teeth, the detent lug is circular in cross-section and extends radially outward from the outer surface of the spring band to engage the circular detents to seat within the circular detents, coupling rotation constraining the arcuate C-shaped band to rotate with the coupling nut and the spring finger to resiliently deflect from abutment face to abutment face during coupling.

An advantage of this invention is a self contained anti-rotation resisting device which is readily adaptable to standard plug shells provided with ratchet teeth arranged annularly.

One way of carrying out the invention is described below with reference to the drawings which illustrate one specific embodiment of this invention, in which:

FIG. 1 as a side view, partially in section, of a disassembled electrical connector assembly including an anti-decoupling device.

FIG. 4 is a partial fragmentary view of one end of the detent spring.

FIG. 5 is an enlarged detail view of FIG. 3.

FIG. 6 is a partial fragmentary view of one end of an alternate detent spring.

FIG. 7 is an enlarged detail view of the alternate detent spring engaging a detent.

Figure 1:
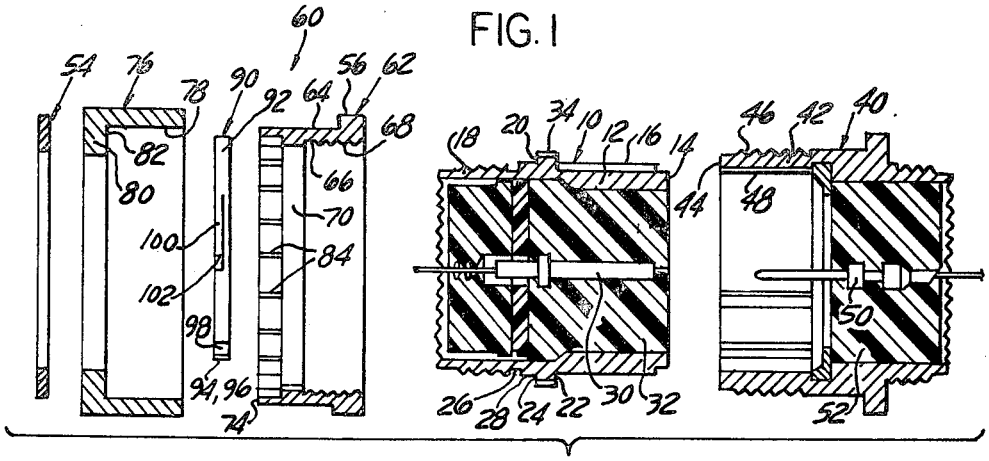

Referring now to the drawings, FIG. 1 shows a disassembled electrical connector assembly, the assembly comprising a first shell 10, a second shell 40, a coupling nut 60 for connecting the first shell to the second shell in mating relationship, a retaining ring 54 for mounting the coupling nut 60 to the first shell and an anti-decoupling detent spring 90.

The first shell 10 is generally cylindrical and comprises a forward portion 12 having forward face 14, a rear portion 18, an annular flange 20 medially of the shell portions and an annular wall 28 circumjacent the annular flange 20, annular flange 20 having front and rear faces 22, 24 facing forwardly and rearwardly and rear portion 18 including an annular groove 26 for receiving retaining ring 54. Typically first shell 10 would be characterized as being a plug-type connector member and would include one or more female-type (i.e., socket) electrical contacts 30 retained within the shell 10 by one or more dielectric inserts 32. The outer surface of the shell forward portion 12 would include one or more axial keys 16 for orienting the first shell relative to the second shell and for non-rotatably drawing the shells together upon mating.

The second shell 40 is generally cylindrical and comprises a forward portion 42 having forward face 44 and including thread 46 on the outside surface thereof. Typically the second shell 40 would be characterized as a receptacle connector and would include one or more axially extending recesses or keyways 48 for receiving the respective keys 16 on first shell 10 and one or more male-type (i.e., pin) electrical contacts 50 that mate within the socket-type contacts 30 in the first shell, the pin contacts being retained in dielectric inserts 52 mounted in the shell 40. Of course, the pin and socket contacts could be other then shown.

The coupling nut 60 is adapted to be received over rear portion 18 of plug shell 10 and comprises a cylindrical coupling sleeve 62 having thread 68 on a portion of inner wall 66 thereof for engaging external thread 46 on second shell 40 and a radial flange 80 for mounting to the first shell, the radial flange having an inner-end wall 82 for abutting against rear face 24 of the annular flange.

Preferably and in accord with this invention the anti-decoupling device for resisting rotation of the coupling nut relative to the first shell comprises first and second sets of detents 34, 84, each set of detents being arranged annularly and radially extending and a detent spring 90 radially interposed between the first and second sets of detents. Detent spring 90, although shown best in FIG. 2, is formed from a relatively flat band 92 of metal into a generally C-shaped member and comprises free ends 94, 96, a pair of detent lugs 98 formed thereon and a pair of deflectable spring fingers 100 extending therefrom as cantilevers to their free ends 102 for successively engaging the first detents 34, the first detents 34 defining a contiguous succession of V-shaped ratchet teeth around annular flange 20.

The coupling nut 60 is compound and comprises inner coupling sleeve 62 having outer wall 64 and an outer coupling sleeve 76 having an inner wall 78 adapted to be telescoped over the inner coupling sleeve and nonrotatably secured thereto, detent spring 90 being adapted to be axially captivated between the inner and outer coupling sleeves 62, 76, the outer coupling sleeve 76 including radial flange 80. Inner coupling sleeve 62 is generally cylindrical and comprises an annular rib 56 extending radially around, outer wall 64 thereof, the inner coupling sleeve 62 being adapted to telescope in clearance (or press) fit within outer coupling sleeve 76 with annular rib 56 forming a limit stop on the outer coupling sleeve 76. Inner coupling sleeve 62 further includes a transverse rear end face 74 and inner wall 66 thereof includes thread 68, the angularly spaced detents 84 and an annular shoulder 70, the annular shoulder 70 being intermediate the detents 84 and internal thread 68, the internal thread 68 being adapted to mate with the external thread 46 on the second shell 40 upon rotation of coupling nut 60 to bring the first and second shells 10, 40 together, whereupon the contacts are mated and forward face 44 and inner end wall 82, respectively, are abutting front and rear faces 22, 24 of annular flange 20.

Figure 2:
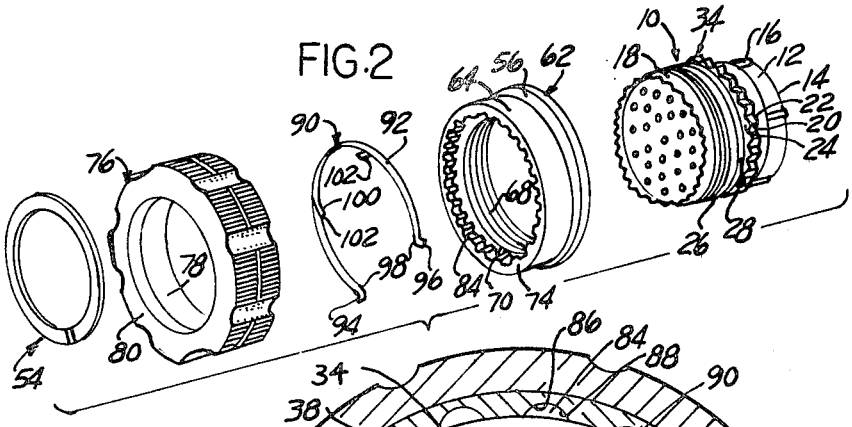
FIG. 2 is an exploded perspective view of an electrical connector member shown in FIG. 1.

FIG. 2 shows coupling nut 60 according to this invention in disassembled relation to first shell 10. Inner and Outer coupling sleeves 62, 76 are generally cylindrical and adapted to telescope together and captivate detent spring 90 axially between annular shoulder 70 and inwardly directed radial flange 80.

The plurality of second detents 84 are curved and extend longitudinaly inward from rear end face 74 of inner coupling sleeve 62. The plurality of first detents 34, shown as V-shaped ratchet teeth, are radially extending and disposed annularly around annular flange 20. Detent spring 90 is generally C-shaped and includes detent lugs 98 for seating in second detents 84 and spring fingers 100 having deffectable ends 102 for engaging first detents 34. Preferably the ends 94, 86 subtend an angle greater than 180°.

Figure 3:
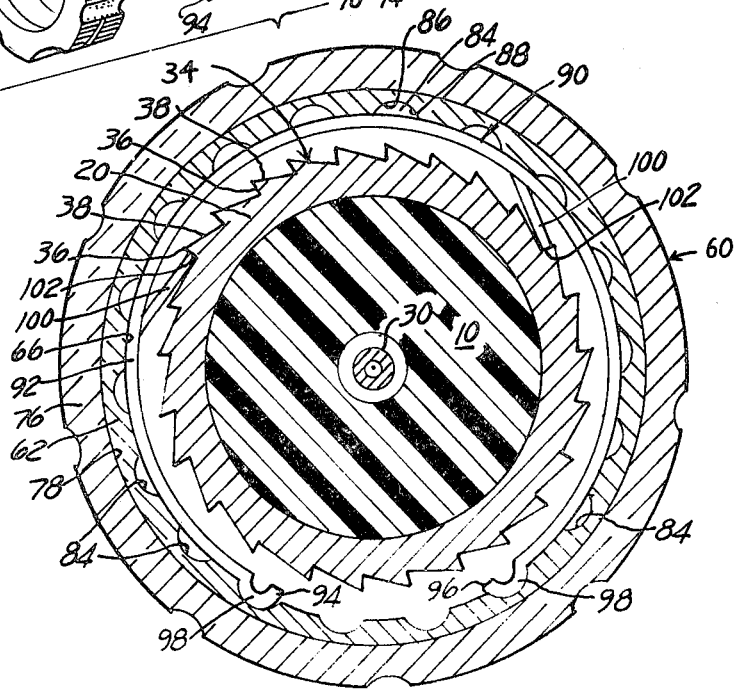
FIG. 3 is an end view, in section, of the connector member of FIG. 2 as assembled and including a detent spring.

FIG. 3 shows a section view of plug connector 10 with inner and outer coupling sleeves 62, 76 immovably staked and positioned about annular flange 20 of the connector with detent spring 90 in position between radially separated first and second detents 34, 84. First detents 34 are V-shaped and include an abutment face 36 and a ramp face 38, the abutment faces being substantially radially extending, the intersection of the abutment face of one ratchet tooth with the ramp face of the adjacent ratchet tooth forming a seat for receiving the spring finger. Second detents 84 are substantially circular in cross-section with opposite portions thereof defining, respectively, first and second detent faces 86, 88. Detent spring 90 is positioned so that the free end 102 of each spring finger 100 extends radially inward from one side of arcuate band 92 to engage one abutment face 36 and seat within adjacent ratchet teeth 34 disposed therearound and detent lug 98 extends radially inward from the other side of arcuate band 92 to seat within a detent 84.

FIG. 4 is one end portion of detent spring 90 showing the distal end 94 with detent lug 98 thereof being generally circular in shape and spring finger 100 being straight and extending radially inward from the band to its deflectable free end 102, the free end being adapted to seat within the succeeding ratchet teeth 34.

FIG. 5 is an enlarged view of a portion of FIG. 3 and the engagement between the free end 102 of spring finger 100 with abutment face 36 and detent lug 98 with faces 86, 88 of detent 84 formed on inner wall 66 of inner coupling sleeve 62.

FIG. 6 shows an alternate embodiment of the detent spring, the alternate spring including a free end 106 and a spring beam 112 extending rearwardly from free end 106 to a detent lug 114, spring beam 112 being a cantilever and lug 114, having a curved end portion.

FIG. 7 shows an alternate embodiment wherein detent faces 86, 88 are other then uniformly curved.

In operation, when coupling nut 60 is rotated in the coupling direction, the spring fingers 100 deflect and advance to each succeeding abutment face 36 forming the ratchet teeth 34. The curved end of each detent lug 98, being disposed within respective detents 84 on the inner periphery of inner coupling sleeve 62, constrain detent spring 90 to rotate therewith, causing the spring fingers to be deflected upwardly and over a ramp face 36 to reseat against the next abutment face 36. However, upon rotation in the uncoupling direction, spring fingers 100 seat against abutment faces 36 to prevent the spring member from rotating and, depending upon the amount of force, to prevent the coupling nut from rotating. However, as a result of increased uncoupling torque on the coupling nut relative to the plug shell 10, the uncoupling force placed against free end 102 is transmitted through detent spring 90 to the detent lug 98, the curvature between detent lug 98 and detent 84 camming each curved detent lug 98 out from its respective detent 84 and uncoupling rotation is therby permitted.

We claim:

1. An anti-decoupling device for an electrical connector assembly, the connector assembly comprising generally cylindrical first and second shells (10, 40) and a coupling nut (60) for interconnecting the shells, said coupling nut being rotatably mounted to said first shell and comprising a cylindrical coupling sleeve (62) connectable with said second shell (40), said anti-decoupling device for retarding unwanted uncoupling rotation of the coupling nut relative to said first shell, said anti-decoupling device characterized by:

a plurality of first detents (34) arranged annularly on said first shell (10) with each said detent having an abutment face (36);

a plurality of second detents (84) arranged annularly on the coupling sleeve (62); and a detent spring (90) interposed between said first and second detents, the detent spring comprising an arcuate band (92) including a detent lug (98) and a resiliently deflectable spring finger (100), said spring finger extending from one side of the band and having a deflectable end (102) adapted to engage the abutment faces (36) and said detent lug extending from the other side of the band and adapted to seat within the second detents (84), external torque tending to rotate said coupling nut in the coupling direction causing the spring finger to deflect and coupling rotation to occur, external torque tending to rotate said coupling nut in the uncoupling direction being transmitted by the detent lug to the spring finger and rotation initially being prevented by said spring finger being forced against said abutment face, further increase in external uncoupling torque causing the detent lug to be cammed outwardly from engagement with the second detent, disengagement of the detent lug thereby allowing uncoupling rotation of the coupling nut.

2. The invention as recited in claim 1, wherein said detent spring (90) comprises a pair spring fingers (100) and a pair of detent lugs (98), each respective pair of spring fingers (90) and detent lugs (98) extending from opposite sides of said detent spring.

3. The invention as recited in claim 1, wherein said coupling sleeve (62) has a rear end face (74) and further includes an annular shoulder (70), said annular shoulder (70) being spaced axially inward from said rear end face (74) and including a rearwardly facing rear end wall (72) extending radially inward from the inner wall of the sleeve; said coupling nut further comprising an outer coupling sleeve (76) immovably telescoped coaxially about coupling sleeve (62) and including a radial flange (80), said radial flange (80) having an inner end wall (82) adapted to abut rear end face (74), the inner end wall (82) and rear end wall (72) defining an annular cavity therebetween to receive detent spring (90).

4. The invention as recited in claim 1 wherein said first shell (10) includes an annular flange (20), said first detents (34) are radially extending and arranged annularly around said annular flange and said second detents (84) are disposed annularly on an inner wall (66) of said inner coupling sleeve (62).

5. The invention as recited in claim 4 wherein said second detents (84) are generally equiangularly disposed around said inner coupling sleeve (62), each second detent (84) being generally arcuately shaped and including first and second detent faces (86, 88) and said detent lug (98) is stamped from said arcuate band (92) and generally circular in cross-section, detent lug (98) being configured to seat within each arcuate detent (84).

6. The invention as recited in claim 2 wherein said detent spring (90) is substantially C-shaped with its opposite ends (94, 96) subtending an angle greater than 180°, and said spring fingers (100) are disposed between the opposite ends.

7. An electrical connector comprising a connector member (10) including an annular flange (20), a coupling nut (60) mounted on the connector member for rotation thereabout, said coupling nut including a coupling sleeve (62) having an inner wall (66) and means for resisting rotation of the coupling nut relative to the connector member, the resisting means acting to resist relative rotation in one direction but not in the other and characterized by:

first and second sets of detents (34, 84), respectively, disposed around said connector member (10) and said inner wall (66), each set of detents (34, 84) being arranged annularly and extending radially with one set of detents (34) including a plurality of abutment faces (36) and the other set of detents (84) including a plurality of first and second detent faces (86, 88); and a detent spring (90) interposed between the connector member (10) and the inner wall (66), said detent spring (90) comprising an arcuate band (92) including a spring finger (100) extending from one side of the band and having a free end (102) adapted to seat against respective of said abutment faces (36) and a detent lug (98) extending from the other side of the band and adapted to be seated between said detent faces (86, 88), substantial external torque being required to overcome resistance by and disengage the detent lug (98) from its detent (84) to rotate said coupling nut (60) in one direction but only nominal external torque being required to rotate the coupling nut (60) in the other direction.

8. The invention as recited in claim 7 wherein said one set of detents (34) are disposed around said connector member and each detent thereof comprises a plurality of V-shaped ratchet teeth with each of the ratchet teeth including said abutment face (36) and a ramp face (38), the intersection of the abutment face (36) and the ramp face (38) forming a contiguous succession of peaks and valleys therearound, the free end (102) of spring finger (100) seating in the valleys to prevent rotation of the detent spring (90) in the one direction but deflecting up and over the peaks to allow rotation of the coupling nut in the other direction.

9. The invention as recited in claim 8 wherein the other set of detents (84) are disposed around said inner wall (66) with each detent thereof being generally circular in cross section.

10. The invention as recited in claim 9 werein said detent lug (98) is generally circular in cross section and adapted to substantially to conform to the coutour of said other detents (84).

11. The invention as recited in claim 8 werein said detent spring (90) includes a pair of detent lugs (98) with one said detent lug (98) being disposed substantially at each opposite end (94, 96) of the arcuate band (92).

12. The invention as recited in claim 8 wherein said detent spring (90) includes a pair of spring fingers (100).

13. The electrical connector as recited in claim 7 wherein said coupling nut (60) further comprises an outer sleeve (76) telescoped about said coupling sleeve (62), the inner coupling sleeve (62) including an annular shoulder (70) disposed about said inner wall and forwardly of said detents (84), said outer sleeve (76) including a radial flange (80) extending radially inward therfrom, the radial flange (80) and said annular shoulder (70) forming an annular cavity therebetween for receiving the detent spring (90).

* * * * *